United States Patent [19]

Verelle et al.

[11] 4,245,745

[45] Jan. 20, 1981

[54] THEFTPROOF RACK FOR THE ACCOMMODATING AND STORING OF SKIS AND POLES

[75] Inventors: Philippe M. Verelle, 1 rue du Général Leclerc, 88000 Epinal, France; Jean-Claude Kilbert, Epinal, France

[73] Assignee: Philippe Marie-Barthélémy Verelles, Epinal, France

[21] Appl. No.: 2,788

[22] Filed: Jan. 11, 1979

[30] Foreign Application Priority Data

Jan. 11, 1978 [FR] France ..... 78 00643

[51] Int. Cl.[3] ..... A47F 7/00

[52] U.S. Cl. ..... 211/8; 70/58; 211/60 SK

[58] Field of Search ..... 211/8, 60 SK, 4; 70/58, 70/464; 224/45 S

[56] References Cited

U.S. PATENT DOCUMENTS

| | | | |
|---|---|---|---|
| 3,307,759 | 3/1967 | Fulton | 224/45 |
| 3,394,790 | 7/1968 | Braun | 211/60 SK X |
| 3,568,902 | 3/1971 | Highberger | 70/58 X |
| 3,874,202 | 4/1975 | Effenheim | 70/58 |
| 3,985,275 | 10/1976 | Allen | 70/58 X |

FOREIGN PATENT DOCUMENTS

| | | | |
|---|---|---|---|
| 198751 | 9/1938 | Switzerland | 211/60 SK |

*Primary Examiner*—Roy D. Frazier
*Assistant Examiner*—Robert W. Gibson, Jr.
*Attorney, Agent, or Firm*—Kenyon & Kenyon

[57] ABSTRACT

The invention relates to a theftproof rack for the stowing away and the storing of skis and ski poles, said rack can, owing to its inviolability, be situated on the outside.

7 Claims, 3 Drawing Figures

THEFTPROOF RACK FOR THE ACCOMMODATING AND STORING OF SKIS AND POLES

The democratization, followed by the popularizing of winter sports, and of skiing in particular, brings annually a greater number of fans to the snow-covered slopes and the problem arises how, at nightfall, the skis can be neatly put away and stored, efficiently, without having a piling of equipment, dripping water and thus soiling the entrances of the premises. The first solution that comes to mind is to provide, on the outside, individual racks, for instance affixed to the wall. However, the problem of implementing this solution resides in the fact that this involes equipment that is relatively expensive and, above all else, readily transportable, which makes thereof an item (skis) that is particularly easy to steal.

So-called "theftproof" devices that can be attached externally do exist, however, they are, as a rule, constituted of actual storage cabinets, key or coin-operated, made in most cases of wood and, therefore, easily broken into. Moreover, these cabinets are high in cost, and their multiplicity, for instance in residences, calls for heavy investments for a safety that leaves to be desired, which discourages sports promoters or hotel owners.

This invention relates, on the contrary, to a device providing complete safety, with regard to theft, while being simple and sturdy in design in view of the fact that it is made up of an ordinary "bracelet" provided with one single closure element ensuring, simultaneously, the confining of the skis and of the poles.

The invention relates therefore to a theftproof rack for the stowing and storing of skis and poles, characterized in that it is made up of at least one U-shaped yoke fastened permanently to a support, with the open portion of said U being provided with a door capable of closing the yoke so as to form a "bracelet" entrapping the skis, said door being itself provided with recesses for the introducing and retaining of the poles and comprising, moreover, a locking element definitively shuttering simultaneously the skis and the poles in their stowage position.

According to a preferred mode of realization, the open face of the yoke is accessible from the front and comprises a door made of two shutters hinged on one and the same pivot, at least one of said shutters being provided with cut-outs for allowing the poles to pass, with said shutters acting in the manner of jaws and confining the said poles while providing for the closing of the yoke so as to shutter definitively the skis in stowage position.

According to one characteristic of this mode of realization, the two shutters are mounted rotatively freely on their common pivot and are made up of U-shaped sheet metal, with the folded-over sides of these shutters facing one another and comprising cut-outs that complement one another, with at least one of the two shutters comprising a striking plate cooperating with the latch of a lock assembly housed in an upright support contiguous to the yoke.

A device in accordance with the invention is illustrated, as a nonlimitative example, on the annexed drawings in which.

Figure 1:
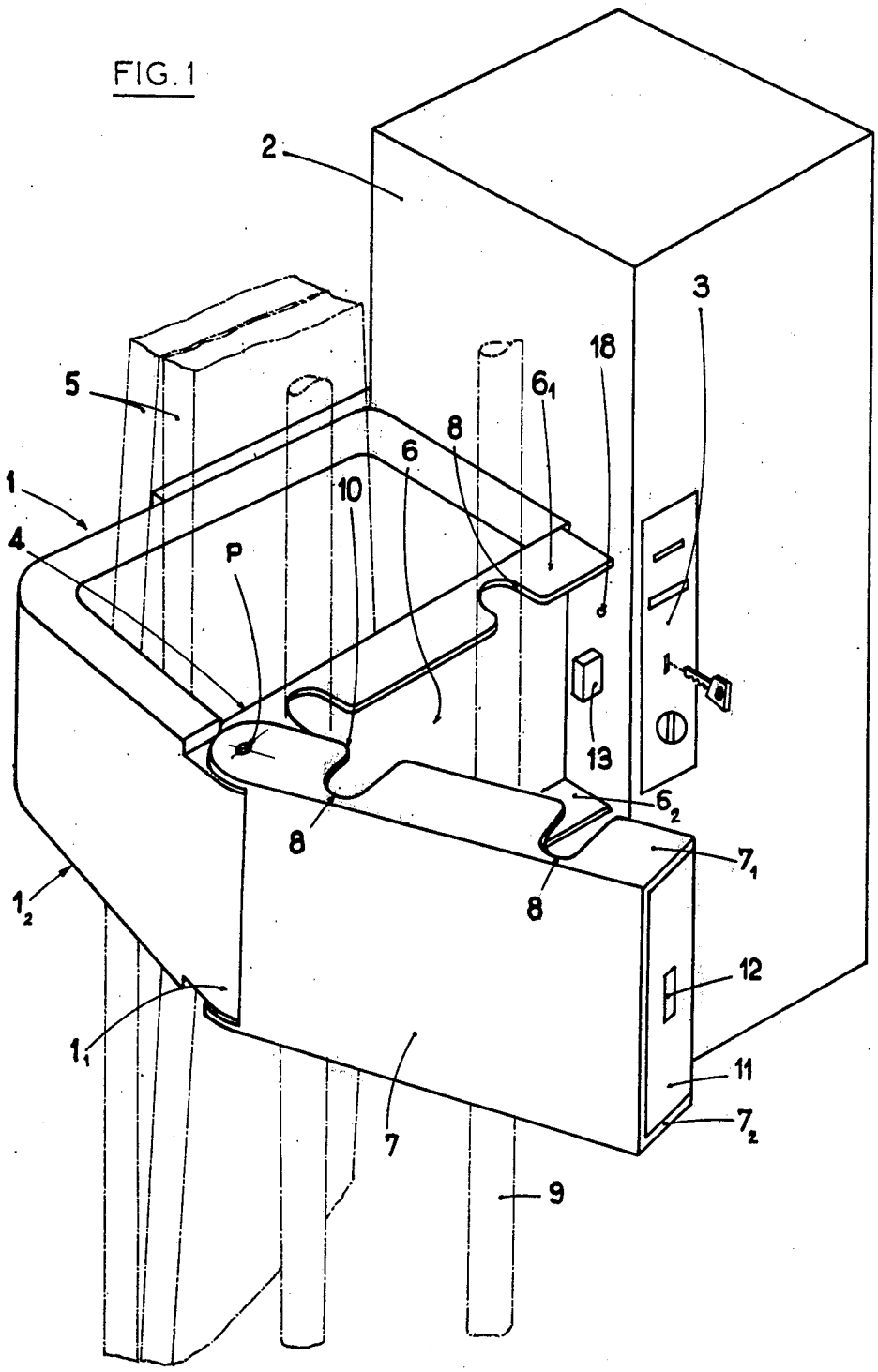
FIG. 1 is a perspective view of one of the elements of the theftproof rack.
Figure 2:
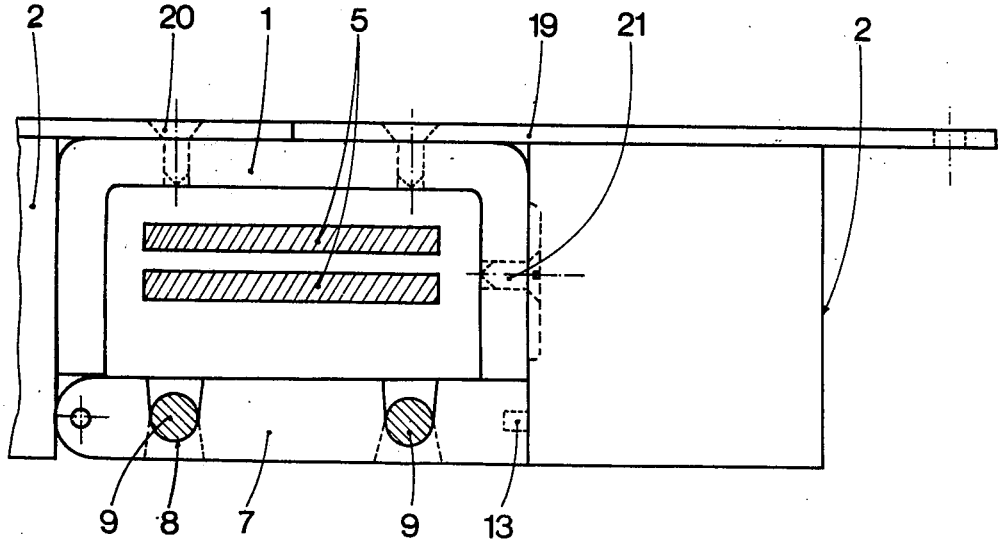
FIG. 2 is a top view of the rack.

According to the mode of realization illustrated in particular on FIGS. 1 and 2, the rack is made up of a series of yokes 1 associated to a sectional element or upright 2 carrying a lock assembly 3 that can be operated by means of a key or a coin collector using coins or tokens.

The yoke shown in the shape of a U can be obtained by bending of a sheet metal or by molding, the open face of said yoke can be covered by a hingedly mounted door that transforms the yoke into an actual "bracelet" designed to lock up a pair of skis 5 as shown in fine [broken] lines on FIG. 1.

To prevent removal of the skis, either downwardly or upwardly, the "bracelet" wraps around the skis in the area situated between the two bindings so that the latter counteract the removal of the skis.

The hinged door that will obturate the yoke is, in the example in question, made up of two shutters 6 and 7 mounted on a common pivot P passing through the extremity of the front wall $\mathbf{1}_1$ of the yoke. Said two shutters are mounted freely on the pivot P and can therefore be moved angularly, independently of one another.

In the example in question, the shutters are designed in the form of a U-shaped part, the sides $\mathbf{6}_1$ $\mathbf{6}_2$ of the shutter 6 are situated opposite the sides $7_1$ $7_2$ of the shutter 7 so that the two shutters nest in one another, with the shutter 6 being slightly smaller than the shutter 7.

This two-shutter door offers the particular feature of being able, simultaneously, the moment it is brought into locking position, to imprison the skis within the yoke 1 and to lock up the ski poles between the two shutters 6 and 7 that act in the way of jaws. To this end, the sides $\mathbf{6}_1$ $\mathbf{6}_2$ of the shutter 6 and the sides $7_1$ $7_2$ of the shutter 7 comprise cut-out sections 8 that complement one another and that make it possible, the moment the two shutters are nested in one another, to keep the ski poles 9 imprisoned, with the cut-outs 8 of the shutter 7 being slightly shifted from the cut-outs 8 of the shutter 6 so that, upon the closing of the two jaws, the poles are not damaged by the corners 10 of the cut-outs 8 which, for this end, have been rounded off. A return spring (not shown) for instance a coil spring surrounding the pivot P, provides for the return of the two shutters into closing position.

The shutter 7 of the door offers the particular feature of comprising a front wall 11 provided with a strikeplate 12 cooperating with the latch 13 of the lock assembly 3 housed in the upright 2 contiguous to the yoke 1.

It is indeed the outer shutter 7 that provides for the simultaneous locking, in closing position, of the shutter 6 and, accordingly, of the yoke 1. Thus, one single lock definitively locks up simultaneously the two shutters of the door and the yoke, by imprisoning also the poles.

In order to perfect security even further and in particular for the event in which the yokes 1 would be situated above ski attaching means, it is possible to provide for the fastening to the ground of a gutter 14 made up of individual basins 15 in each one of which the rear end of the skis 5 is placed. Accordingly, with the bindings of the skis abutting beneath the face $\mathbf{1}_2$ (FIG. 1) of the yoke 1, it is no longer possible to move the skis upwardly in order to disengage them from the edge 16 of the basins so that the skis cannot be removed downwardly either.

Figure 3:
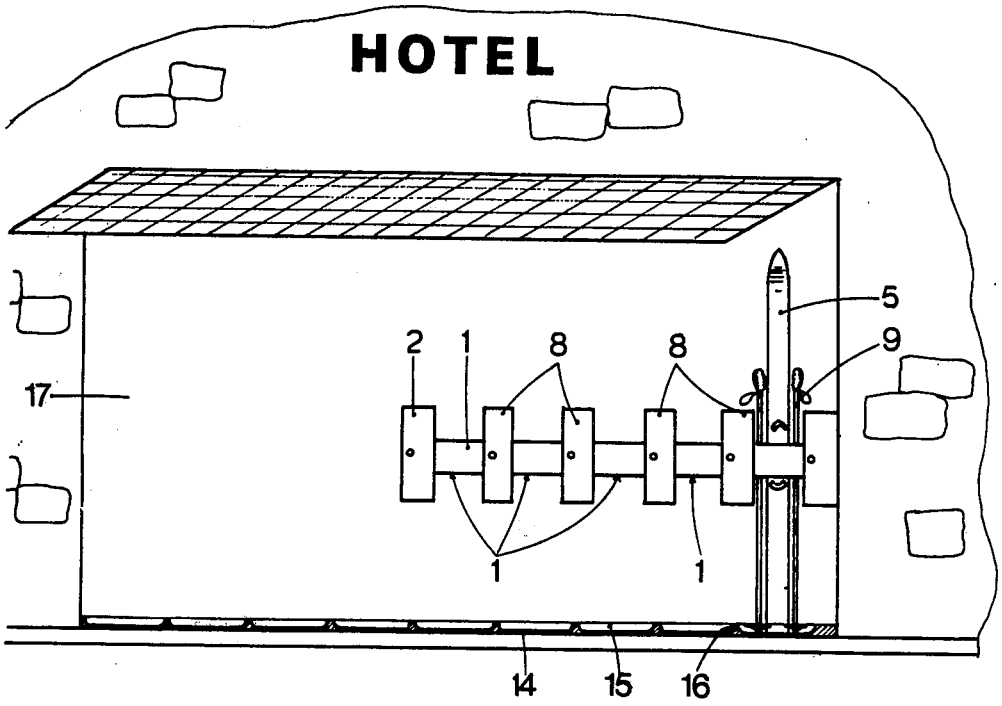
FIG. 3 is a side elevation of the rack assembly fastened to the outside of a building.

In view of its theftproof nature, this rack could be fastened to the outside of a building, for instance to a shed as shown in FIG. 3. In that case, one will increase the number of yokes 1 and of the uprights 2 to as many units as necessary.

In view of the fact that the rack is intended to remain on the outside, the upright 2 is to be provided with a greasing hole 18 (FIG. 1) making it possible to introduce into the interior of the mechanism of the lock assembly an antifreeze product, grease, or a lubricant.

In this case, the yokes of the rack could be fastened directly to the wall or onto a support assembly 19 by means of anchoring elements such as screws 20, with the side branches of said yoke being, besides, fastened to the uprights 2 by other screws 21, which constitutes a stable and absolutely nondismantable assembly.

This device is simple in design and offers great security against theft.

It is of course understood that the invention is not limited to the realization example described above and illustrated and one could provide other forms and other modes of realization without thereby going beyond the scope of the invention.

We claim:

1. A theftproof rack for the stowing away and storing of skis and poles comprising:

(a) a support;

(b) at least one yoke, in a shape of a U, permanently affixed to said support;

(c) a door comprising two shutters hingedly mounted to a single pivot for closing the opened portion of said U to form a bracelet imprisoning the skis, at least one said shutters having cut-outs for receiving and retaining ski poles, said two shutters cooperating to grip and imprison said ski poles when said door is closed to imprison the skis in a storage position; and (d) a locking device, for simultaneously and positively locking said skis and poles in said storage position.

2. A theftproof rack according to claim 1 wherein the end of the outside one of said shutters opposite said pivot forms a strike plate and wherein said locking device comprises a lock assembly, housed in a support upright contiguous to said yoke, having a latch cooperating with said strike plate, whereby the locking of said strike plate by said latch will insure the simultaneous positive locking of the other, contiguous shutter, said other shutter closing the U of the yoke thereby imprisoning the skis.

3. A theftproof rack according to claim 1 wherein said two shutters are mounted so as to be freely rotatable on said single pivot and wherein said shutters are formed of U-shaped sheet metal, folded over sides of said shutters facing one another, with cut-outs of complementary design formed in said folded over sides, and further comprising a spring biasing said shutters into a closed position, and wherein said locking device comprises a lock assembly housed in a support upright contiguous to said yoke, said lock assembly having a latch cooperating with at least one of said shutters forming a strike plate for said latch.

4. A theftproof rack according to claim 3 and further including a lock assembly support associated with said yoke, said lock assembly support being actuated by means of a key, a coin or token-operated coin machine.

5. A theftproof rack according to claim 3 wherein the one of said shutters forming a strike plate is disposed on the outside so that when said strike plate is locked by the latch of the lock assembly it will simultaneously positively lock the other, contiguous shutter, said other contiguous shutter thereby closing the U of the yoke to imprison the skis.

6. A theftproof rack according to any one of claims 1–5 and further including basins with raised edges at ground level adapted for housing the rear ends of the skis.

7. A theftproof rack according to claim 4 wherein said lock assembly includes an aperture accessible from the outside permitting the introduction of an antifreeze or greasing solution into the lock mechanism.

* * * * *